United States Patent [19]

Stover

[11] 4,176,871

[45] Dec. 4, 1979

[54] FIREPLACE TONGS

[76] Inventor: Donald E. Stover, R.R. 1, Box 151, Carey, Ohio 43316

[21] Appl. No.: 942,381

[22] Filed: Sep. 14, 1978

[51] Int. Cl.[2] ..... A47J 49/14

[52] U.S. Cl. ..... 294/10; 294/16; 294/103 R

[58] Field of Search ..... 294/9-11, 294/14, 15, 16, 34, 50.9, 58, 103 R, 117

[56] References Cited

U.S. PATENT DOCUMENTS

| | | | |
|---|---|---|---|
| 741,816 | 10/1903 | McKinniss | 294/11 |
| 1,254,765 | 1/1918 | Binn | 294/11 |
| 1,370,860 | 3/1921 | Truax | 294/11 |
| 1,853,899 | 4/1932 | Haverstick | 294/11 |
| 2,096,104 | 10/1937 | Green | 294/11 |

*Primary Examiner*—Johnny D. Cherry
*Attorney, Agent, or Firm*—Frost & Jacobs

[57] ABSTRACT

Fireplace tongs comprising a tubular stationary member including a handle located at one end, and a telescoping member having one end slidably received within the stationary member. The stationary and telescoping members include downwardly depending claw-like arcuate tines for gripping a log therebetween. An elongated handle is pivotally attached to one end of the upper side of the telescoping member and terminates at its opposite end in a handle. The telescoping member is shiftable between an open and a closed position for accepting and firmly holding a log.

5 Claims, 3 Drawing Figures

FIREPLACE TONGS

BACKGROUND OF THE INVENTION

1. Field of the Invention.

The present invention relates to fireplace accessories in general and to a fireplace tool, in particular, for grasping and moving fireplace logs.

2. Description of the prior art.

Fireplace tools for lifting and munipulating fireplace logs are well known in the art and have experienced ever increasing utilization as wood burning fireplaces have filled the gap for residential heating requirements. Where such fireplace tools were once considered decorative and ornamental implements, they are now accepted as useful and even necessary aids for obtaining maximum use and efficiency from wood burning fireplace installations.

It has been found that the previous emphasis on aesthetic rather than utilitarian features of the fireplace tools has resulted in implements which are partially or wholly inoperative. For example, difficulty has been experienced in producing a fireplace tool with the ability to accept a wide range of log sizes. In addition, some tools have been damaged by repeated contact with the high temperatures associated with a well-stoked wood fire. The size of the tool is also a critical factor in order to position the operator a safe distance from the fire itself. Finally, many fireplace users, particularly those advanced in years or of unsound health to whom the warmth supplied by a wood burning fireplace may be the only source of residential heating, have expressed dissatisfaction with prior art fireplace tools which are heavy and cumbersome. This drawback has led to makeshift ways of munipulating logs in the fireplace, often compromising the safety and health of the user as well as endangering property from wayward sparks and the like.

SUMMARY OF THE INVENTION

The fireplace tool contemplated by the present invention overcomes the limitations of prior art apparatus for manipulating fireplace logs by providing a simple, safe and easily operated device which can accept a wide range of log sizes, and in addition can be operated amidst the fireplace flames with minimum danger to person or property.

In a preferred embodiment, the fireplace tongs comprise a hollow tubular stationary member having at one end a looped handle adapted to be grasped by one hand of the operator, and having a pair of spaced apart parallel downwardly depending arcuate claw-like tines attached at its opposite end. The stationary member slidably receives a telescoping member having one end terminating in a single downwardly depending arcuate claw-like tine of opposite curvature to the tines associated with the stationary member. The telescoping member may be secured to the stationary member by means of a loop chain to prevent their separation. In addition, the end of the telescoping member adjacent the downwardly depending tine is formed in the shape of a probe point for adjusting logs and the like.

An elongate rod-like lift member terminating at one end in a looped handle adapted to be grasped by one hand of the operator is pivotally attached at its opposite end to the upper side of the telescoping member opposite the downwardly depending tine. By grasping the looped handles, the operator may lower the downwardly depending tines over a log to be manipulated, and by drawing the looped handle attached to the lift member toward the operator, bring the downwardly depending tines into abutting contact with the log on opposite sides thereof. The log may then be lifted and moved to the proper position by holding the looped handle associated with the stationary member fixed, this handle acting as a pivot point, and further drawing back on the looped handle associated with the lift member, thereby producing considerable leverage and mechanical advantage with little effort on the part of the operator. To release the log, the looped handle associated with the lift member is pushed away from the operator, therby bringing the tines out of contact with the outer surface of the log.

BRIEF DESCRIPTION OF THE DRAWINGS

FIG. 2 is a fragmentary side elevation view, partially in cross-section, of a preferred embodiment of the fireplace tool of the present invention shown in the closed or log grasping position.

DESCRIPTION OF THE PREFERRED EMBODIMENTS

Figure 1:
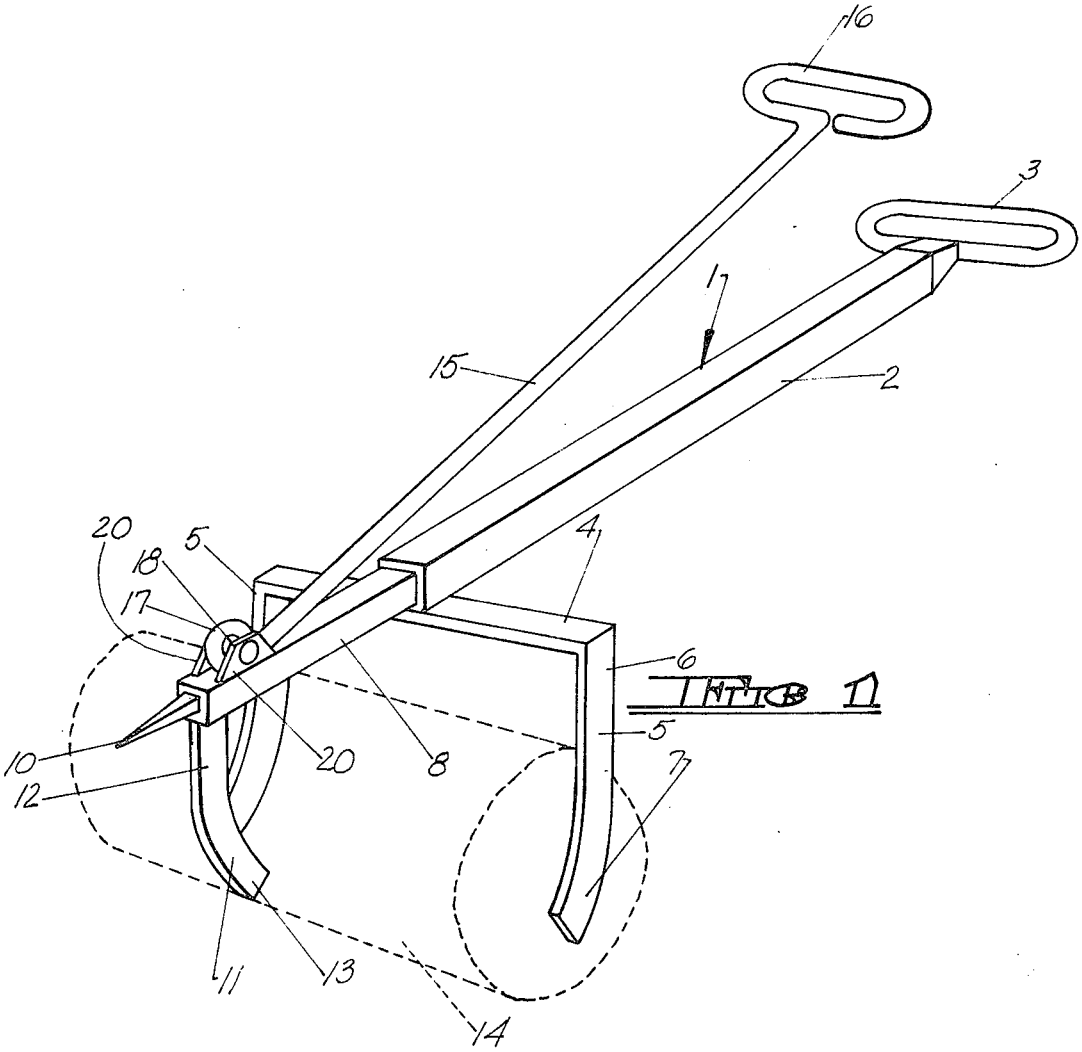
FIG. 1 is a perspective view of a preferred embodiment of the fireplace tool of the present invention.
Figure 3:
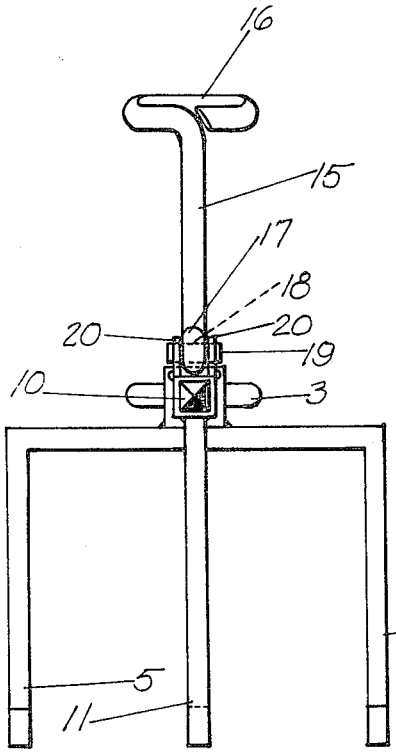
FIG. 3 is a front elevation view of a preferred embodiment of the fireplace tool of the present invention.
Figure 3:
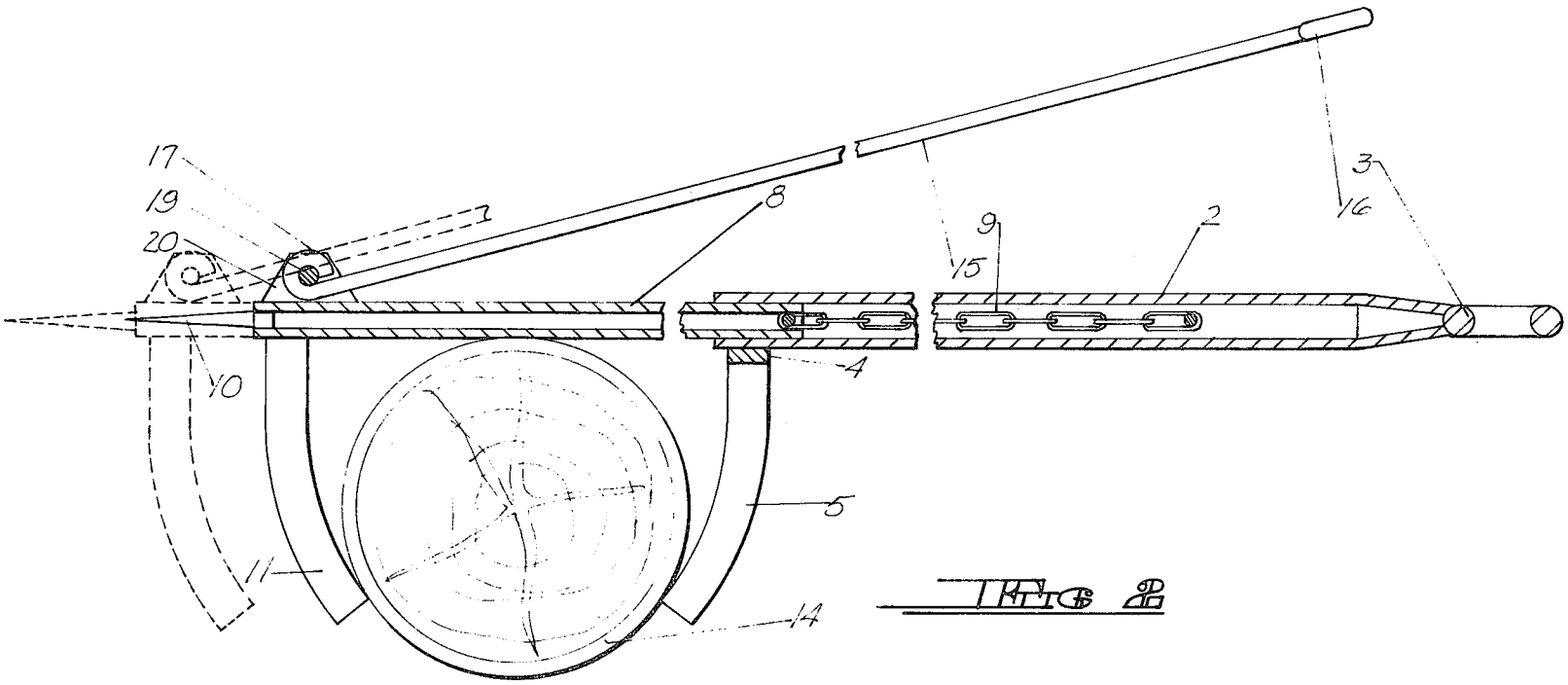

Turning to FIG. 1, a perspective view of a preferred embodiment of the fireplace tool of the present invention, shown generally at 1, is illustrated. The tool comprises a hollow tubular stationary member 2 having located at one end a horizontal looped handle 3 adapted to be grasped by one of the operator's hands. While for purposes of an exemplary showing, tubular stationary member 2 has been illustrated in the form of a hollow box-like enclosure, it will be understood that the actual cross-sectional shape of stationary member 2 is not critical, and may take other configurations, such as cylindrical, elliptical or the like. Stationary member 2, as well as other parts of the tool to be described, may be constructed from iron, steel, aluminum or any other flame proof and light-weight material. Handle portion 3 may comprise an integral part of stationary member 2, or may be formed from a separate hollow or solid metallic rod, for example, and attached to tubular stationary member 2 by welding or the like.

A flat horizontal support bar 4 is attached approximately at its midpoint to the lower surface of tubular stationary member 2 at the end of member 2 opposite that containing handle 3. Depending downwardly from either end of support bar 4 is a claw-like tine 5. Each tine comprises a vertical straight portion 6, the upper end of which is attached to support bar 4 by welding or the like, and an arcuate portion 7 depending from straight portion 6. Arcuate portion 7 is configured to bend toward the front end of stationary member 2, i.e., away from handle portion 3, the curvature of arcuate portions 7 being such as to abuttingly engage the outer surface of the usual sizes of logs used in a residential wood burning fireplace. Downwardly depending tines 5 are substantially parallel and are spaced apart a distance for accommodating the usual length of logs used in a residential wood burning fireplace. While tines 5 and support bar 4 have been described as separate structures, joined by welding or the like, it will be understood that they may be formed from a continuous bar-like stock, tine portions 5 being formed by right angle bends formed in the bar stock.

A telescoping member 8 having the same general exterior configuration as the interior configuration of stationary member 2, is slidably received within stationary member 2. Telescoping member 2 may be constructed of tubular material, as is best seen in FIG. 2, or may be of solid construction as desired. Telescoping member 8 is prevented from becoming disengaged from stationary member 2 by a loop chain or the like joining members 2 and 8. In order to prevent chain 9 from becoming entangled during operation of the tool, it has been found advantageous to locate chain 9 within the hollow interiors of stationary member 2 and telescoping member 8. The ends of chain 9 may be secured to the walls of members 2 and 8 by screws, rivets, pins or the like.

The opposite end of telescoping member 2 is formed in the shape of a pointed probe 10 which can be used to adjust the fire wood within the fireplace. While the probe point 10 has been illustrated in a four-sided pyramid shape, it will be understood that the probe may also be configured as conical, etc.

Attached to the lower surface of telescoping member 8 adjacent probe point 10 is a downwardly depending claw-like tine 11, similar in construction to tines 5. Tine 11 comprises a straight vertical portion 12 and an arcuate portion 13. Arcuate portion 13 is configured to curve toward tines 5 for abutting the opposite surface of the fireplace logs. As illustrated in FIG. 1 in connection with a typical log 14 shown in phantom, tine 12 assumes a position approximately midway between tines 5 but on the opposite side of log 14. This arrangement assures extremely stable contact with log 14 thereby assuring safe and dependable munipulation of the log.

Although for purposes of an exemplary showing, fireplace tool 1 has been illustrated and described as having a pair of spaced claw-like tines 5 depending downwardly from either end of support bar 4, and telescoping member 8 is supplied with a similar oppositely disposed downwardlly depending tine 11, it will be understood that fireplace tool 1 may be constructed with the relative position of tines 5 and 11 reversed; i.e. support bar 4 bearing a pair of spaced claw-like tines 5 curving rearwardly toward handle 3 may be affixed to the forwardmost end of telescoping member 8, while a single downwardly depending forwardly curved tine 11 may be attached to the lowermost surface of stationary member 2. Furthermore, it will be understood that the present invention is contemplated to include the embodiment wherein downwardly depending tine 11 is replaced by a substantially horizontal support bar similar to support bar 4 attached at its approximate midpoint to the forwardmost end of telescoping member 8 and containing a pair of downwardly depending spaced claw-like tines similar to tines 5 but curving rearwardly toward handle 3.

An elongate rod-like lift member 15 is pivotally attached to the upper surface of telescoping member 8 adjacent probe point 10. The upper end of lift member 15 terminates in a looped handle 16 adapted to be grasped by one of the operator's hands. Lift member 15 and handle 16 may be formed of a continuous rod-like material, or may be constructed separately and joined by welding or the like. The lower end of lift member 15 is formed in the shape of a circular loop 17 having an aperture 18 therethrough for accepting a pivot pin 19. Aperture 18 and pivot pin 19 are so dimensioned as to allow lift member 15 to freely pivot about pivot pin 19. The ends of pivot pin 19 are non-rotatably supported by a pair of parallel upstanding journals 20 rigidly affixed, by welding or the like, to the upper surface of telescoping member 8.

In operation, the user grasps handle 3 associated with stationary member 2 in one hand, and handle 16 associated with lift member 15 in the other. By holding handle 3 stationary and pushing slightly on handle 16, telescoping member 8 may be slidably extended from stationary member 2 to the position shown in phantom in FIG. 2. In this position, the tool may be lowered over the log to be manipulated such that the lower surface of telescoping member 8 rests upon the upper surface of the log to be manipulated, such as that depicted at 14 in FIG. 2. Still holding handle 3 stationary, the user pulls on handle 16, thereby telescoping inwardly telescoping member 8 and stationary member 2 until the oppositely disposed tines are brought into abutting contact with the opposite surfaces of log 14. It will be observed that tines 5 and 11 are so dimensioned as to accept a wide range of log sizes therebetween. To lift the log, handle 3 is held stationary and further pulling pressure is applied to handle 16 to cause the entire tool to pivot about handle 3. Depending upon the angle formed between lift member 15 and the axis of stationary member 2 and telescoping member 8, considerable leverage and mechanical advantage can be applied to lift and manipulate sizable logs with minimum effort. When the log has been moved to the desired location, pressure is released on handle 16, lowering log 14 into place. Thereafter, by pushing on handle 16 while holding handle 3 stationary, tines 5 and 11 may be separated, reversing the procedure described hereintofore, to release log 14 and remove the tool.

For purposes of storage, telescoping member 8 may be moved to the fully retracted position, thereby minimizing the overall length of the tool. In addition, lift member 15 may be lowered substantially parallel with stationary member 2 and telescoping member 8 so that the overall depth of the tool is minimized. It will be understood that the tool may be painted or otherwise decorated to provide a pleasing appearance when stored in association with a wood burning fireplace.

It will be understood that various changes in the details, materials, steps and arrangements of parts, which have herein been described and illustrated in order to explain the nature of the invention, may be made by those skilled in the art within the principle and scope of the invention as expressed in appended claims.

The embodiments of the invention in which an exclusive privilege or property is claimed are as follows:

1. A fireplace tool comprising a tubular stationary member having grasping means located at one end and one or more downwardly depending claw-like tines attached to the opposite end, a telescoping member having one end slidably received within said stationary member and the opposite end terminating in one or more downwardly depending claw-like tines, and an elongate lift member pivotally attached at one end to the upper side of said telescoping member adjacent said tine bearing end and terminating at its opposite end in grasping means, said telescoping member being shiftable between an open position wherein said one or more tines depending from said stationary member are spaced from said one or more tines depending from said telescoping member for accepting a log therebetween and a closed position wherein said one or more tines depending from said stationary member and said one or more tines depending from said telescoping member may be brought into abutting contact with the outer surfaces of the log.

2. The fireplace tool according to claim 1 wherein said one or more tines depending from said stationary member comprises a pair of spaced parallel tines, and said one or more tines depending from said telescoping member comprises a single downwardly depending claw-like tine.

3. The fireplace tool according to claim 1 including means for securing said telescoping member to said stationary member to prevent their disengagement when said tool is shifted toward said open position.

4. The fireplace tool according to claim 1 wherein said tool includes a pointed probe located on the forwardmost end of said telescoping member.

5. The fireplace tool according to claim 1 wherein said tines include a straight portion and an arcuate portion, said arcuate portions of said one or more tines depending from said stationary member curving toward said one or more tines depending from said telescoping member, and wherein said arcuate portion of said one or more tines depending from said telescoping member curves toward said one or more tines depending from said stationary member.

* * * * *